US006251848B1

(12) United States Patent
Holderbaum et al.

(10) Patent No.: US 6,251,848 B1
(45) Date of Patent: Jun. 26, 2001

(54) BULL'S-EYE TABLET

(75) Inventors: Thomas Holderbaum, Monheim; Hans-Josef Beaujean, Dormagen; Christian Nitsch; Juergen Haerer, both of Duesseldorf; Markus Semrau, Timmaspe; Karl-Martin Faeser, Duisburg, all of (DE)

(73) Assignee: Henkel Kommanditgesellschaft Auf Aktien, Duesseldorf (DE)

( * ) Notice: Subject to any disclaimer, the term of this patent is extended or adjusted under 35 U.S.C. 154(b) by 0 days.

(21) Appl. No.: 09/433,231

(22) Filed: Nov. 4, 1999

(30) Foreign Application Priority Data

Dec. 5, 1998 (DE) ..... 198 56 214

(51) Int. Cl.[7] ..... C11D 17/00

(52) U.S. Cl. ..... 510/446; 510/191; 510/224; 510/294; 510/298; 252/175; 252/176

(58) Field of Search ..... 510/191, 224, 510/294, 298, 446; 252/175, 176

(56) References Cited

U.S. PATENT DOCUMENTS 3,279,995 * 10/1966 Reid ..... 510/446
3,407,144 * 10/1968 Bath ..... 510/298
3,557,003 * 1/1971 Morris et al. ..... 510/298
4,256,599 * 3/1981 Krisp et al. ..... 510/117
4,767,559 * 8/1988 Kruse et al. ..... 510/114
4,996,061 * 2/1991 Webb et al. ..... 424/475
5,133,892 * 7/1992 Chun et al. ..... 510/224
5,759,974 * 6/1998 Menke et al. ..... 510/191
5,962,387 * 10/1999 Gorlin et al. ..... 510/224
5,972,870 * 10/1999 Anderson ..... 510/298

FOREIGN PATENT DOCUMENTS 0 055 100 6/1982 (EP) .
0 481 547 4/1992 (EP) .
0 481 792 4/1992 (EP) .
0 481 793 4/1992 (EP) .
WO97/03177 1/1997 (WO) .

* cited by examiner

*Primary Examiner*—Lorna M. Douyon
(74) *Attorney, Agent, or Firm*—Wayne C. Jaeschke; Glenn E.J. Murphy

(57) ABSTRACT

Bull's-eye tablets in which both the shaped body per se and the lands surrounding the bull's-eye are mechanically stable and even lend themselves to production in modern high-throughput tablet presses and in which the core placed in the larger shaped body is joined to the tablet in a stable manner and does not separate from the tablet matrix during production, packaging, transportation and handling can be obtained if the contour line of the core falls from the edge zone to the lowest point and climbs back to the edge zone.

20 Claims, No Drawings

BULL'S-EYE TABLET

This invention relates to detergent shaped bodies which allow active substances to be separated from one another and which are designed as a special case of a core/jacket shaped body. More particularly, the invention relates to shaped bodies of detergents and washing aids such as, for example, dishwasher tablets, detergent tablets, cleaning tablets, bleach tablets, stain remover tablets, water softening tablets and lavatory cleaning tablets.

Detergent shaped bodies are widely described in the prior-art literature and are enjoying increasing popularity among consumers because they provide for easy dosing, require minimal packaging and are aesthetically attractive. Various designs of such shaped bodies are known from the prior art and from everyday living, ranging from various shapes (angular, round, etc.) and colors to multiphase shaped bodies. Multilayer tablets ("two-phase tabs"), ring/core tablets and core/jacket tablets have established themselves in the prior art, above all for releasing various active substances at different rates or for separating ingredients which are incompatible with one another. Bull's-eye tablets are core/jacket tablets in which the core is not surrounded in all directions by the jacket, but instead is visible at the surface of the tablet.

European patent application 005 100 (Jeyes Group), for example, describes lavatory cleaning tablets in the form of recessed tablets, core/jacket tablets and ring/core tablets. This document describes several possible forms in general terms but does not go into special geometries in the case of bull's-eye tablets. The drawings of this patent application show bull's-eye tablets in which the visible core is flush with the tablet surface (FIGS. 1, 2 and 6) or projects trapezoidally therefrom (FIGS. 10, 11 and 12). The contour line of the underneath of the core is always either parallel to the base of the tablet or is trapezoidal with a part parallel to the base of the tablet.

European patent application 481 547 (Unilever) describes multilayer detergent tablets in the form of ring/core tablets which comprise at least three layers (inner layer, barrier layer and outer layer). This document, which is not concerned with bull's-eye tablets, does not discuss geometric parameters either.

Multiphase or multilayer detergent shaped bodies are described, for example, in European patent applications EP 481 792 (Unilever), EP 481 793 (Unilever) and International patent application WO 97/03177 (Benckiser).

Bull's-eye tablets are not widely described in the prior art because their production involves particular problems. Thus, the outlay on machinery is considerable because a core first has to be formed by compression and then introduced by a transfer and centering mechanism into a bed of premix which, after compression, provides the bull's-eye tablet. Compared with a conventional two-layer tablet, therefore, at least two tablet presses have to be available for a bull's-eye tablet because the core visible at the surface is smaller (and hence requires a smaller die) than the tablet carrying the core. On the other hand, the core has to be precompressed to form a shaped body sufficiently stable to be able to be moved by the transfer and centering mechanism. In this way, the adhesion between the core and the tablet carrying it is reduced to the point where, in the extreme case, the core can become separated from the tablet.

During the compression of particulate premixes to form a bull's-eye tablet, the premix to be compressed is subjected to a greater load where the core is placed than at the margins where the surface of the shaped body carrying the core is visible. It is precisely bull's-eye tablets which are often attended by the problem that the mechanical stability of the tablet is too low. Thus, the region, which surrounds the "bull's-eye", often disintegrates when the top punch is withdrawn or the premix is compacted to a greater extent under the shaped body so that, subsequently, this part of the tablet does not dissolve as well as the rest which can have an extremely adverse effect in the case of detergent tablets in particular.

On the other hand, bull's-eye tablets have advantages which make them particularly attractive as detergent tablets. Special detergent ingredients can be precompressed in the core so that incompatible constituents are separated. Another factor not to be ignored is the aesthetic aspect because, by virtue of their "fried egg structure", bull's-eye tablets have a high consumer appeal.

Now, the problem addressed by the present invention was to provide a detergent shaped body in the form of a bull's-eye tablet which would not have any of the disadvantages mentioned above. In particular, both the shaped body per se and the regions surrounding the bull's-eye would be mechanically stable and would even lend themselves to production in modern high-throughput tablet presses. The "bull's-eye", i.e. the core placed in the larger shaped body, would be joined to the tablet in a stable manner and would not separate from the tablet matrix during production, packaging, transportation and handling. Above all, the problems of the poorer solubility of those parts of the "jacket" situated under the core would be solved.

It has now been found that the shape of the core to be inserted has a critical bearing on the solution to the problems stated above.

The present invention relates to a detergent shaped body ("bull's-eye tablet") of compressed particulate material comprising a core and a jacket surrounding this core, characterized in that the contour line of the core falls from the edge zone to the lowest point and climbs again to the edge zone.

According to the invention, therefore, the core inserted into the larger shaped body does not have any faces parallel to the underneath of the tablet, but instead opens into a lowest point. Accordingly, square cores or cores with a trapezoidal underneath are excluded from the scope of the invention. According to the invention, bull's-eye tablets in which the contour line of the core falls steadily from the edge zone to the lowest point and climbs steadily back to the edge zone represent particularly preferred embodiments of the invention. If a vertical cut is made through a shaped body according to the invention, two regions can be seen in the most simple case, namely: the core and the shaped body surrounding the core. After the edge zone of the surface of the shaped body carrying the core comes the first foot point of the core (point A) of which the lowest point is called point X and of which the second foot point is called point B. Now, the contour line AXB falls (preferably steadily) over the section AX and climbs (preferably steadily) over the section XB. The lowest point X of the core is the point which is the least far from the base of the shaped body.

In principle, therefore, contour lines AXB in the form of triangles are possible. Surprisingly, bull's-eye tablets with cores such as these are superior to standard core shapes in regard to core adhesion and the solubility of the other regions of the shaped body (beside and under the core). However, in view of the mechanical instability of the triangle apex (correctly: pyramidal point), rounded contour lines AXB are preferred. Accordingly, preferred contour lines AXB are semicircular or elliptical and should not have any plateau because this would be contrary to the requirement for the (preferably steady) climb and fall. In this way, the other regions of the shaped body (beside and under the core) are guaranteed the greatest possible homogeneity in regard to dissolving behavior.

The foregoing descriptions relate to the contour line of the inserted core which subsequently lies in the shaped body, i.e. to the underneath of the core. The contour line of the core, which lies almost on the surface of the shaped body, does not have to meet the requirements in regard to the fall and climb and to the steadiness thereof and, for example, may be rectangular or again round or elliptical. Accordingly, cores suitable for use in accordance with the invention, for example, may be flush with the surface, may project trapezoidally from the surface or —for example —may be ellipsoidal in shape. According to the invention, preferred bull's-eye tablets are characterized in that the core projects from the surface of the shaped body. Spheres are another possible shape for the core. The foregoing considerations were based on a core either round or elliptical in plan. According to the invention, the core may of course also be triangular, tetragonal, pentagonal, hexagonal, etc. in cross-section or in plan. Another core suitable for use as the "bull's-eye" in accordance with the invention, for example, may have a rectangular base and a dome-like underneath.

The dimensions of the core placed in the shaped body are advantageously selected so that the "lands" i.e. those regions in which, in a vertical section, only substance of the shaped body surrounding the core is visible, are wide enough to guarantee adequate mechanical stability. According to the invention, bull's-eye tablets in which the ratio between the length of the core and the length of the shaped body is, in all, <0.9:1, preferably<0.85:1 and more preferably<0.8:1 are preferred. Similar considerations also apply to the width of the shaped bodies so that, in preferred bull's-eye tablets, the ratio between the width of the core and the width of the shaped body is<0.9:1, preferably<0.85:1 and more preferably ≦0.8:1 and most preferably <0.7:1.

The core may project from the surface of the bull's-eye tablets according to the invention by a certain amount. In this case, preferred bull's-eye tablets are characterized in that the height of the core, as measured from the top of the shaped body from which the core projects, is less than 30%, preferably less than 20% and more preferably less than 10% of the height of the shaped body as measured without the core.

In other words, bull's-eye tablets in which the overall height of the bull's-eye tablet (including the core) is at most 1.3 times, preferably at most 1.2 times and, more preferably, at most 1.1 times the height of the shaped body (as measured without the core) represent preferred embodiments of the invention.

The quotient of the width of the distance from the edge of the core to the edge of the shaped body ("land width") and the width of the shaped body may also be used to define the width of the margins between the edge of the shaped body and the beginning of the core projecting from the surface. This quotient is referred to hereinafter as the "relative land width".

The relative land width is a quantity which is independent of the geometry of the shaped body and the geometry of the core. In the case of a rectangular shaped body with a symmetrically arranged rectangular core, the land width is constant over the entire land. In the case of a round or ellipsoidal core, the land width varies because the curvature of the core increases the distance to the edge of the shaped body. In cases such as these, the absolute land width is the smallest distance from the edge of the core to the edge of the shaped body. In the case of shaped bodies whose "bull's-eyes" (cores) have a different shape from the shaped body itself, the land width in the case of a longitudinal section through the shaped body can have another value than in the case of a cross-section. This is readily possible in accordance with the present invention as long as the criteria mentioned in the following are satisfied for each relative land width to be determined. For technical reasons, a limited number of land widths will always be preferred because symmetrically arranged cores have a distinctly higher aesthetic appeal than non-symmetrically arranged cores. Technically advantageous embodiments are, for example, round tablets with a concentrically arranged round core (a single land width), square shaped bodies with a round core of which the center also lies at the center of the square (one land width), rectangular shaped bodies with a round or elliptical symmetrically arranged core (one or two land widths, depending on the design) and rectangular shaped bodies with a symmetrically arranged rectangular core (one or two land widths, depending on the design).

The concept of the "relative land width" is illustrated by a longitudinal section through the shaped body where L stands for the length of the—for example—rectangular shaped body, L2 stands for the length of the core and L1 and L3 stand for the land widths. With symmetrically arranged cores (irrespective of whether they are round, oval or angular), L1 and L3 are identical. The relative land width is the quotient of L1 and L or L3 and L. Similar considerations apply to a cross-section through the—for example-rectangular shaped body, i.e. the width B is different from the length L of the shaped body. The land widths and relative land widths and the width of the recess can be calculated in the same way as for the longitudinal section. Any measure of length may be used to determine the absolute land width because the physical unit is divided out by formation of the quotient so that the relative widths are dimensionless.

According to the present invention, preferred bull's-eye tablets have a relative land width of less than 0.4, preferably less than 0.3 and, in a particularly preferred embodiment less than 0.25.

The land width can vary according to the absolute size of the shaped body. Normally, however, the relative land width is at least 0.005, preferably at least 0.01 and, in a particularly preferred embodiment, at least 0.015. The relative land width selected will be greater, the smaller the shaped body per se in order to ensure that the land widths are still practicable and safe to handle. The expert will have no problems in selecting the land widths, so that the minimum widths mentioned may be regarded as approximate values which may be varied in accordance with the present teaching.

In the same way as a relative land width, it is also possible to define a relative core height. Entirely analogously, H in the example mentioned above would stand for the overall height of the shaped body and H1 for the height of the core (as measured from the surface of the tablet, i.e. only the part which projects). The quotient of H1 and H is thus the relative core height. According to the invention, the relative core height (see above) is preferably≦0.3. Detergent shaped bodies in which the relative core height is less than 0.25, preferably less than 0.2 and more preferably less than 0.1 represent particularly preferred embodiments of the invention.

Preferred bull's-eye tablets are rectangular in shape and have different relative land widths in longitudinal section and cross-section. The cores of tablets such as these may advantageously be round, elliptical or rectangular.

According to the invention, however, it is also possible to produce rectangular bull's-eye tablets in which the relative land widths are identical in longitudinal section and cross-section. In this case, too, the cores may advantageously be round, elliptical or rectangular.

In the case of the rectangular shaped bodies mentioned, the effect of the identical relative land width in longitudinal section and cross-section is that the absolute land widths are different in view of the differences between length and width. The sole exception are the shaped bodies with a square base as a special case of a rectangle in which the same relative widths bring about the same absolute widths. According to the present invention, the expert may select identical or different absolute and relative land widths, depending on the preferred aesthetic impression.

According to the invention, the bull's-eye tablets may also readily be circular in shape.

The expert can select suitable shapes for the core in dependence upon the shape of the detergent shaped body; there are no limits to the freedom of formulation, so that even octagonal shaped bodies with round or rectangular (or other) cores are also feasible. In their case, a maximum of eight relative land widths would have to be taken into consideration. Preferred shapes for the cores (in plan) are rectangular, circular or elliptical cores.

According to the present invention, the combination of the multilayer principle known from the prior art with bull's-eye tablets is particularly attractive. According to the invention, it is possible and preferred to produce a detergent shaped body of two or more layers which contains a core in its uppermost layer. In this way, the aesthetic impression can be further enhanced by differently coloring the two layers and using a third color for the core. According to the invention, therefore, bull's-eye tablets in which the shaped body carrying the core consists of two or more layers are preferred.

So far as the ingredients of the individual regions of the shaped body are concerned, the expert is not confronted by any limits. By virtue of the division into shaped body and multiphase core, coupled with the fact that the shaped body can in turn be divided into various phases or layers, the range of design possibilities available is almost limitless.

What is claimed is:

1. A detergent shaped body comprising a jacket of compressed particulate material and a core of compressed particulate material, the jacket having an outer surface, the core being at least partially embedded in but not through the jacket and having an exposed outer surface, the portion of the core embedded in the jacket forming a contour in contact with the jacket that is nowhere parallel to the outer surface of the jacket.

2. The body of claim 1, wherein the exposed outer surface of the core projects from the outer surface of the jacket.

3. The body of claim 1, wherein the ratio of the length of the core to the length of the shaped body is 0.9.

4. The body of claim 3, wherein the ratio of the length of the core to the length of the shaped body is 0.85.

5. The body of claim 4, wherein the ratio of the length of the core to the length of the shaped body is 0.8.

6. The body of claim 1, wherein the ratio of the width of the core to the width of the shaped body is 0.9.

7. The body of claim 6, wherein the ratio of the width of the core to the width of the shaped body is 0.85.

8. The body of claim 7, wherein the ratio of the width of the core to the width of the shaped body is 0.8.

9. The body of claim 2, wherein the core projects from the outer surface of the jacket less than 30% of the distance between the outer surface of the jacket and the point at which the core begins to project from the outer surface of the jacket.

10. The body of claim 9, wherein the core projects from the outer surface of the jacket less than 20% of the distance between the outer surface of the jacket and the point at which the core begins to project from the outer surface of the jacket.

11. The body of claim 10, wherein the core projects from the outer surface of the jacket less than 10% of the distance between the outer surface of the jacket and the point at which the core begins to project from the outer surface of the jacket.

12. The body of claim 1, wherein the relative land width is less than 0.4.

13. The body of claim 12, wherein the relative land width is less than 0.3.

14. The body of claim 13, wherein the relative land width is less than 0.25.

15. The body of claim 1, wherein the body is rectangular in shape and the relative land widths in longitudinal section and cross-section are different.

16. The body of claim 1, wherein the body is rectangular in shape and the relative land widths in longitudinal section and cross-section are identical.

17. The body of claim 1, wherein the body is round in shape.

18. The body of claim 1, wherein the core is rectangular in plan.

19. The body of claim 1, wherein the core is elliptical in plan and in cross-section.

20. The body of claim 1, wherein the body comprises two or more layers.

* * * * *